US011600427B2

(12) United States Patent
Park et al.

(10) Patent No.: US 11,600,427 B2
(45) Date of Patent: Mar. 7, 2023

(54) COIL COMPONENT

(71) Applicant: SAMSUNG ELECTRO-MECHANICS CO., LTD., Suwon-si (KR)

(72) Inventors: Kwang Il Park, Suwon-si (KR); Jong Min Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 601 days.

(21) Appl. No.: 16/666,965

(22) Filed: Oct. 29, 2019

(65) Prior Publication Data

US 2020/0321155 A1 Oct. 8, 2020

(30) Foreign Application Priority Data

Apr. 5, 2019 (KR) ..... 10-2019-0040209

(51) Int. Cl.
*H01F 27/28* (2006.01)
*H01F 27/29* (2006.01)
(Continued)

(52) U.S. Cl.
CPC ..... *H01F 27/2804* (2013.01); *H01F 27/245* (2013.01); *H01F 27/29* (2013.01);
(Continued)

(58) Field of Classification Search
CPC ..... H01F 27/2804; H01F 2027/2809; H01F 17/0013; H01F 17/0006; H01F 5/003; H01F 27/29; H01F 27/292; H01F 27/245
(Continued)

(56) References Cited

U.S. PATENT DOCUMENTS

2003/0030510 A1* 2/2003 Sasaki ..... H05K 3/3442 333/185
2009/0085707 A1* 4/2009 Mi ..... H01F 27/29 336/200
(Continued)

FOREIGN PATENT DOCUMENTS

CN 104766691 A 7/2015
CN 105742035 A 7/2016
(Continued)

OTHER PUBLICATIONS

Office Action issued in corresponding Chinese Patent Application No. 202010057700.X dated Jul. 29, 2021, with English translation.
(Continued)

*Primary Examiner* — Tszfung J Chan
(74) *Attorney, Agent, or Firm* — Morgan, Lewis & Bockius LLP

(57) ABSTRACT

A coil component includes a body having a first surface and a second surface facing each other, and having a plurality of wall surfaces connecting the first surface to the second surface; an insulating substrate; a coil portion comprising a first lead-out pattern and a second lead-out pattern each covered with the body and disposed on the insulating substrate; a first external electrode and a second external electrode disposed on the first surface of the body and spaced apart from each other; a first connection electrode and a second connection electrode respectively extending from the first and second lead-out patterns to the first and second external electrodes; and a first support portion and a second support portion respectively extending from the coil portion to be exposed to one of the plurality of wall surfaces, and respectively disposed to be spaced apart from the first and second lead-out patterns.

17 Claims, 6 Drawing Sheets

(51) Int. Cl.
*H01F 41/04* (2006.01)
*H01F 41/02* (2006.01)
*H01F 27/245* (2006.01)

(52) U.S. Cl.
CPC ..... *H01F 41/0233* (2013.01); *H01F 41/041* (2013.01); *H01F 2027/2809* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 2014/0009254 | A1* | 1/2014 | Ohkubo | H01F 17/0033 336/192 |
| 2015/0048915 | A1* | 2/2015 | Yoon | H01F 17/0013 336/192 |
| 2016/0189840 | A1 | 6/2016 | Ahn et al. | |
| 2018/0012696 | A1 | 1/2018 | Lee et al. | |
| 2018/0174740 | A1 | 6/2018 | Muneuchi | |
| 2018/0358169 | A1* | 12/2018 | Nishikawa | H01F 27/292 |
| 2018/0358171 | A1 | 12/2018 | Jung et al. | |
| 2019/0115143 | A1* | 4/2019 | Tachibana | H01F 27/292 |
| 2020/0279687 | A1* | 9/2020 | Koo | H01F 17/04 |

FOREIGN PATENT DOCUMENTS

| | | | | |
|---|---|---|---|---|
| CN | 108231338 | A | 6/2018 | |
| CN | 109087775 | A | 12/2018 | |
| CN | 111627674 | A | 9/2020 | |
| JP | 2014197590 | A * | 10/2014 | H01F 17/0033 |
| KR | 10-2015-0019730 | A | 2/2015 | |
| KR | 10-2016-0031391 | A | 3/2016 | |
| KR | 10-2018-0006246 | A | 1/2018 | |

OTHER PUBLICATIONS

Chinese Office Action dated Nov. 10, 2021 , issued in corresponding Chinese Patent Application No. 202010057700.X.

* cited by examiner

COIL COMPONENT

CROSS-REFERENCE TO RELATED APPLICATION(S)

This application claims the benefit of priority to Korean Patent Application No. 10-2019-0040209 filed on Apr. 5, 2019 in the Korean Intellectual Property Office, the entire disclosure of which is incorporated herein by reference.

TECHNICAL FIELD

The present disclosure relates to a coil component.

BACKGROUND

An inductor, a coil component, is a typical passive electronic component used in electronic devices, along with a resistor and a capacitor.

With higher performance and smaller sizes gradually implemented in electronic devices, the number of coil components used in electronic devices has been increasing and becoming smaller.

SUMMARY

An aspect of the present disclosure is to provide a thinner coil component.

Another object of the present disclosure is to maintain the position of a coil portion within a body to be relatively constant while thinning the coil portion.

According to an aspect of the present disclosure, a coil component includes a body having a first surface and a second surface facing each other in one direction, and having a plurality of wall surfaces connecting the first surface and the second surface to each other; an insulating substrate embedded in the body; a coil portion comprising a first lead-out pattern and a second lead-out pattern, each covered with the body and disposed on the insulating substrate; a first external electrode and a second external electrode disposed on the first surface of the body and spaced apart from each other; a first connection electrode and a second connection electrode respectively extending from the first and second lead-out patterns to the first and second external electrodes; and a first support portion and a second support portion respectively extending from the coil portion to be exposed to one of the plurality of wall surfaces of the body, and respectively disposed to be spaced apart from the first and second lead-out patterns.

According to another aspect of the present disclosure, a coil component includes a body having a first surface and a second surface facing each other in one direction, and having a plurality of wall surfaces connecting the first surface and the second surface to each other; an insulating substrate embedded in the body; a coil portion comprising a first lead-out pattern and a second lead-out pattern respectively disposed on the insulating substrate; a first external electrode and a second external electrode disposed on the first surface of the body, being spaced apart from each other, and respectively connected to the first and second lead-out patterns; and at least one support portion extending from the coil portion to be exposed to one of the plurality of wall surfaces of the body, and being spaced apart from the first and second lead-out patterns.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
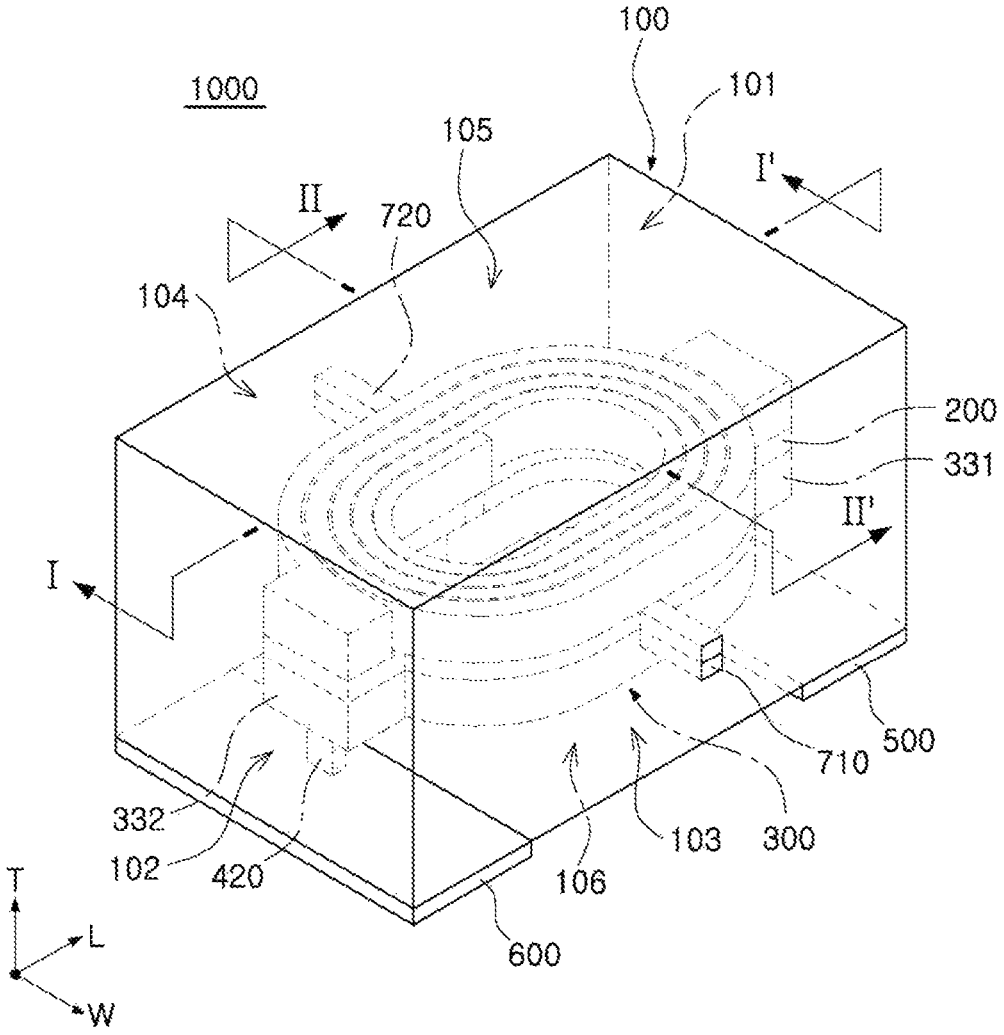
FIG. 1 is a schematic view illustrating a coil component according to an exemplary embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (longitudinal) direction, a W direction is a second direction or a width direction, a T direction is a third direction or a thickness direction.

Hereinafter, a coil component according to an exemplary embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

Figure 2:
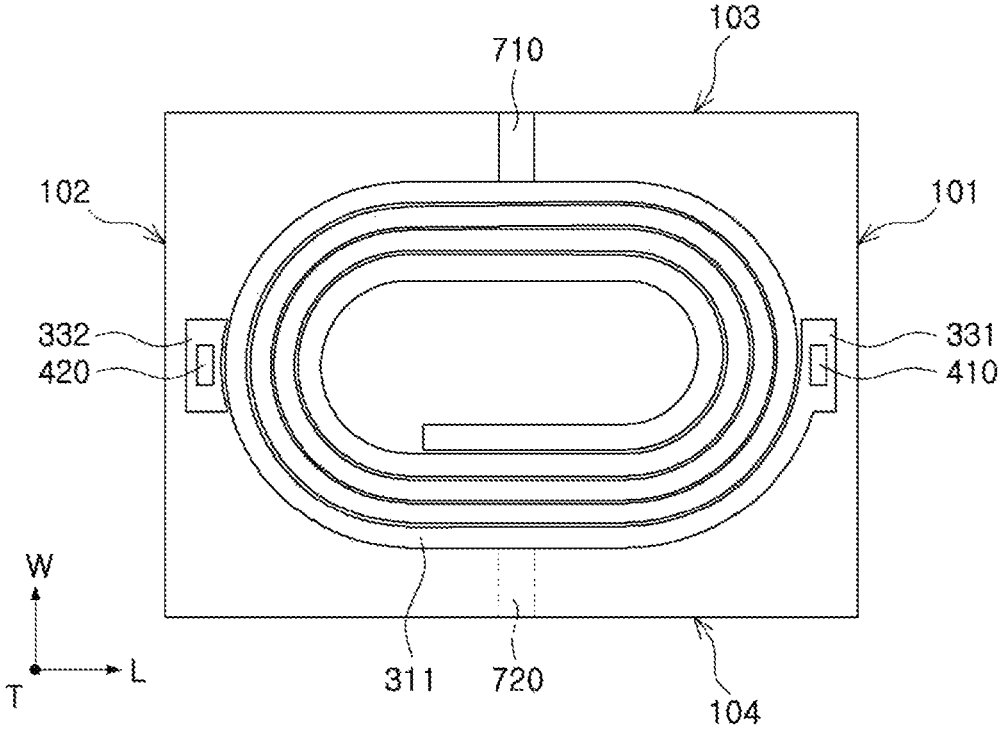
FIG. 2 is a view illustrating the coil component of FIG. 1 taken in a downward direction.
Figure 3:
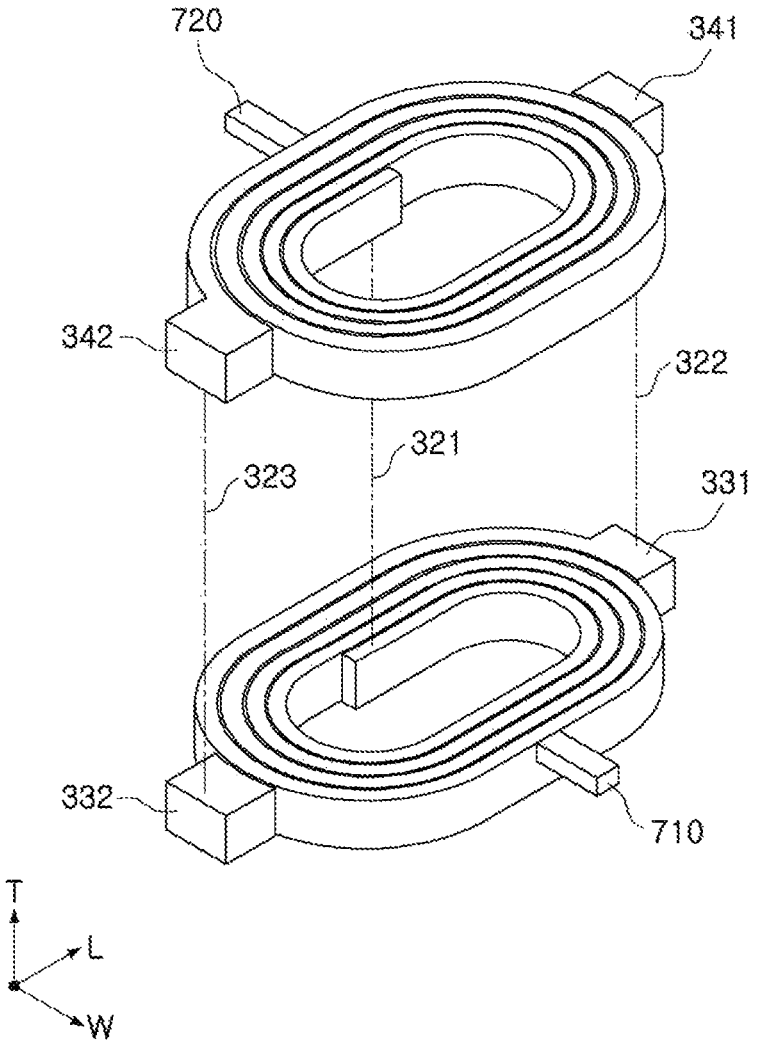
FIG. 3 is an exploded view illustrating a coil portion.
Figure 4:
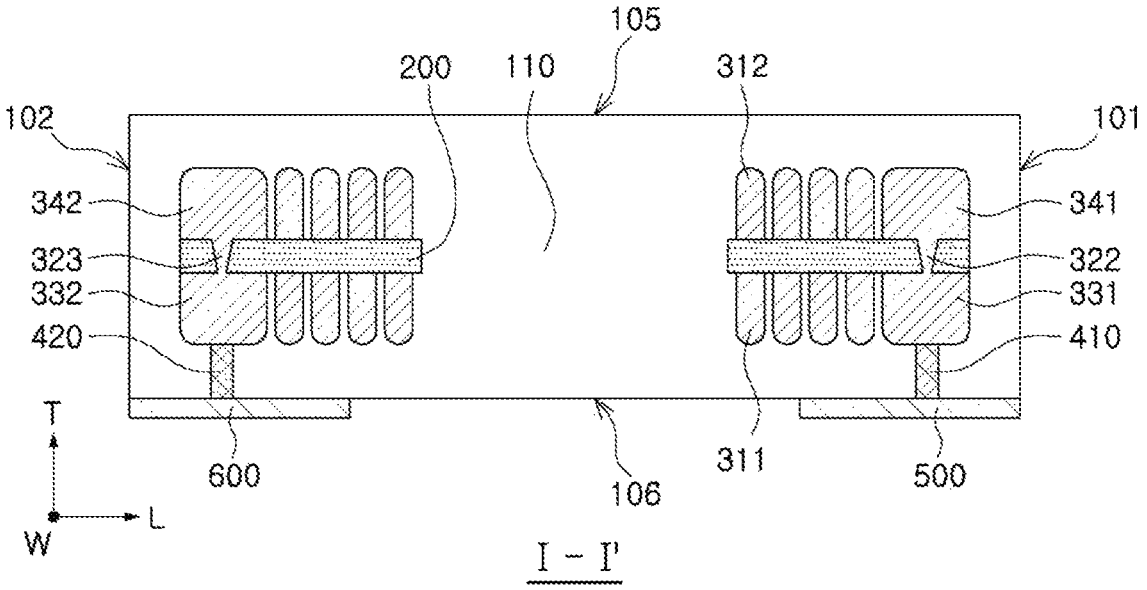
FIG. 4 is a cross-sectional view taken along line I-I' of FIG. 1.
Figure 5:
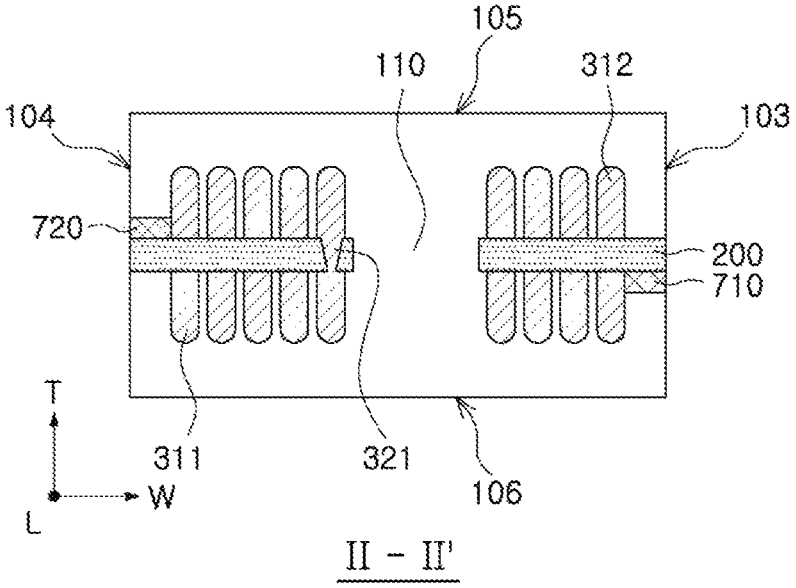
FIG. 5 is a cross-sectional view taken along line II-II' of FIG. 1.

FIG. 1 is a schematic view illustrating a coil component according to an exemplary embodiment of the present disclosure. FIG. 2 is a view illustrating FIG. 1 in a downward direction. FIG. 3 is an exploded view illustrating a coil portion. FIG. 4 is a cross-sectional view taken along line I-I' of FIG. 1. FIG. 5 is a cross-sectional view taken along line II-II' of FIG. 1. FIGS. 6A to 6D schematically illustrate a modified example of a support portion, respectively, corresponding to FIG. 2.

Although FIG. 2 is a view illustrating FIG. 1 in a downward direction, a first coil pattern, first and second lead-out patterns, and first support portion are illustrated by a solid line by projecting them on a fifth surface 105 of a body 100, for convenience of explanation. In addition, FIG. 2 does not illustrate external electrodes for convenience of explanation.

Referring to FIGS. 1 to 6, a coil component 1000 according to exemplary embodiments of the present disclosure may include a body 100, an insulating substrate 200, a coil portion 300, connection electrodes 410 and 420, external electrodes 500 and 600, and support portions 710 and 720.

The body 100 may form an exterior of the coil component 1000 according to an exemplary embodiment of the present disclosure, and the insulating substrate 200 and the coil portion 300 may be embedded therein.

The body 100 may be formed to have a hexahedral shape overall.

Referring to FIGS. 1, 2, 4, and 5, the body 100 may include a first surface 101 and a second surface 102 facing each other in a length direction L, a third surface 103 and a fourth surface 104 facing each other in a width direction W, and a fifth surface 105 and a sixth surface 106 facing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body 100, and both side surfaces of the body 100 may refer to the third surface 103 and the fourth surface 104 of the body 100.

The body 100 of the coil component 1000 according to an exemplary embodiment of the present disclosure, in which the external electrodes 500 and 600 to be described later are formed, may be formed to have a length of 4.0 mm or less, a width of 4.0 mm or less, and a thickness of 1.5 mm or less, but is not limited thereto.

The body 100 may include a magnetic material and an insulating resin. Specifically, the body 100 may be formed by stacking at least one magnetic composite sheet containing the insulating resin and the magnetic metal powder particles dispersed in the insulating resin. The body 100 may have a structure other than the structure in which the magnetic material may be dispersed in the insulating resin. For example, the body 100 may be made of a magnetic material such as ferrite.

The magnetic material may be, for example, a ferrite powder or a metal magnetic powder.

Examples of the ferrite powder may include at least one of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder may include at least one of iron (Fe), silicon (Si), chromium (Cr), cobalt (Co), molybdenum (Mo), aluminum (Al), niobium (Nb), copper (Cu), and nickel (Ni), and alloys thereof. For example, the metal magnetic powder may be at least one of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder may be amorphous or crystalline. For example, the metal magnetic powder may be a Fe—Si—B—Cr-based amorphous alloy powder, but is not limited thereto.

The ferrite powder and the metal magnetic powder may have an average diameter of about 0.1 μm to 30 μm, respectively, but are not limited thereto.

The body 100 may include two or more types of magnetic materials dispersed in an insulating resin. In this case, the term "different types of magnetic materials" means that magnetic materials dispersed in an insulating resin are distinguished from each other by, for example, an average diameter, a composition, crystallinity, a shape, etc.

The insulating resin may include an epoxy, a polyimide, a liquid crystal polymer, or the like, in a single form or in combined forms, but is not limited thereto.

The body 100 may include a core 110 passing through the coil portion 300, which will be described later. The core 110 may be formed by filling through holes of the coil portion 300 with a magnetic composite sheet, but is not limited thereto.

The insulating substrate 200 may be embedded in the body 100. The insulating substrate 200 may be configured to support the coil portion 300 and the support portions 710 and 720, which will be described later.

The insulating substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the insulating substrate 200 may be formed of an insulating material such as prepreg, Ajinomoto Build-up Film (ABF), FR-4, a bismaleimide triazine (BT) resin, a photoimageable dielectric (PID), and the like, but are not limited thereto.

As the inorganic filler, at least one selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the insulating substrate 200 is formed of an insulating material including a reinforcing material, the insulating substrate 200 may provide better rigidity. When the insulating substrate 200 is formed of an insulating material not containing glass fibers, the insulating substrate 200 may be advantageous for reducing a thickness of the overall coil portion 300. When the insulating substrate 200 is formed of an insulating material containing a photosensitive insulating resin, the number of processes for forming the coil portion 300 may be reduced. Therefore, it may be advantageous in reducing production costs, and a fine via may be formed.

The coil portion 300 may be embedded in the body 100 to manifest the characteristics of the coil portion. For example, when the coil component 1000 according to an exemplary embodiment of the present disclosure is used as a power inductor, the coil portion 300 may function to stabilize the power supply of an electronic device by storing an electric field as a magnetic field and maintaining an output voltage.

The coil portion 300 may include coil patterns 311 and 312, lead-out patterns 331 and 332, auxiliary lead-out patterns 341 and 342, and vias 321, 322, and 323.

In particular, based on the directions of FIGS. 4 and 5, a first coil pattern 311, a first lead-out pattern 331, and a second lead-out pattern 332 may be disposed on a lower surface of the insulating substrate 200, facing the sixth surface 106 of the body 100, and a second coil pattern 312, a first auxiliary lead-out pattern 341, and a second auxiliary lead-out pattern 342 may be disposed on an upper surface of the insulating substrate 200.

Referring to FIGS. 3 to 5, on the lower surface of the insulating substrate 200, the first coil pattern 311 may be in contact with the first lead-out pattern 331, and the first coil pattern 311 and the first lead-out pattern 331 may be spaced apart from the second lead-out pattern 332. On the upper surface of the insulating substrate 200, the second coil pattern 312 may be in contact with the second auxiliary lead-out pattern 342, and the second coil pattern 312 and the second auxiliary lead-out pattern 342 may be spaced apart from the first auxiliary lead-out pattern 341. A first via 321 may pass through the insulating substrate 200 to respectively contact the first coil pattern 311 and the second coil pattern 312, a second via 322 may pass through the insulating substrate 200 to respectively contact the first lead-out pattern 331 and the first auxiliary lead-out pattern 341, and a third via 323 may pass through the insulating substrate 200 to respectively contact the second lead-out pattern 332 and the second auxiliary lead-out pattern 342. In this configuration, the coil portion 300 may function as a single coil which forms one or more turns about the core 110 as a whole.

Each of the first coil pattern 311 and the second coil pattern 312 may be in a planar spiral shape having at least one turn formed about the core 110. For example, the first coil pattern 311 may form at least one turn about the core 110 on the lower surface of the insulating substrate 200.

The lead-out patterns 331 and 332, and the auxiliary lead-out patterns 341 and 342 may be covered by the body 100, respectively. For example, the first to sixth surfaces 101, 102, 103, 104, 105, and 106 of the body 100 may be not exposed. In the case of the present disclosure, the lead-out patterns 331 and 332 may be not exposed to the first to sixth surfaces 101, 102, 103, 104, 105, and 106 of the body 100, respectively, although the lead-out portions of the conventional thin film type coil component are generally exposed to both end surfaces of the body in the length direction L. The above reasons and the effects stemming therefrom will be described later.

At least one of the coil patterns 311 and 312, the vias 321, 322, and 323, the lead-out patterns 331 and 332, or the auxiliary lead-out patterns 341 and 342 may include at least one conductive layer.

For example, when the second coil pattern 312, the auxiliary lead-out patterns 341 and 342, and the vias 321, 322, and 323 are disposed on the other surface of the insulating substrate 200 by a plating process, each of the second coil pattern 312, the auxiliary lead-out patterns 341 and 342, and the vias 321, 322, and 323 may include a seed layer of electroless plating layers, or the like, and an electroplating layer. In this case, each of the seed layer and the electroplating layer may have a single-layer structure or a multilayer structure. The electroplating layer of the multilayer structure may be formed using a conformal film structure in which one electroplating layer is covered by another electroplating layer, and another electroplating layer is only stacked on one side of the one electroplating layer, or the like. The seed layer of the second coil pattern 312, the seed layers of the auxiliary lead-out patterns 341 and 342, and the seed layers of the vias 321, 322, and 323 may be integrally formed, and no boundary therebetween may occur, but are not limited thereto. The electroplating layer of the second coil pattern 312, the electroplating layers of the auxiliary lead-out patterns 341 and 342, and the electroplating layers of the vias 321, 322, and 323 may be integrally formed, and no boundary therebetween may occur, but are not limited thereto.

As another example, based on the directions of FIGS. 1, 3, 4, and 5, when the first coil pattern 311 and the lead-out patterns 331 and 332, arranged on a side of the lower surface of the insulating substrate 200, and the second coil pattern 312 and the auxiliary lead-out patterns 341 and 342, arranged on a side of the upper surface of the substrate 200, are separately formed and then stacked on the insulating substrate 200 in a batch to form the coil portion 300, the vias 321, 322, and 323 may include a high melting point metal layer, and a low melting point metal layer having a melting point lower than a melting point of the high melting point metal layer. In this case, the low melting point metal layer may be formed of a solder containing lead (Pb) and/or tin (Sn). The low melting point metal layer may be melted at least in part due to the pressure and the temperature at the time of stacking in a batch. As a result, for example, an intermetallic compound (IMC) layer may be formed at a portion of a boundary between the low melting point metal layer and the second coil pattern 312.

Based on the directions of FIGS. 4 and 5, the coil patterns 311 and 312, the lead-out patterns 331 and 332, and the auxiliary lead-out patterns 341 and 342 may be protruded from the lower surface and the upper surface of the insulating substrate 200, respectively. As another example, the first coil pattern 311, and the lead-out patterns 331 and 332 may be protruded from the lower surface of the insulating substrate 200, and the second coil pattern 312, and the auxiliary lead-out patterns 341 and 342 may be embedded in the upper surface of the insulating substrate 200, to expose each of the upper surfaces of the second coil pattern 312, and the auxiliary lead-out patterns 341 and 342 from the upper surface of the insulating substrate 200. In this case, since a recess may be formed in the upper surface of each of the upper surfaces of the second coil pattern 312, and the auxiliary lead-out patterns 341 and 342, the upper surface of each of the upper surfaces of the second coil pattern 312, and the auxiliary lead-out patterns 341 and 342, and the upper surface of the insulating substrate 200 may not be located on the same plane. As another example, the second coil pattern 312 and the auxiliary lead-out patterns 341 and 342 may protrude from the upper surface of the insulating substrate 200, and the second coil pattern 312 and the auxiliary lead-out patterns 341 and 342 may be embedded in the lower surface of the insulating substrate 200, to expose the lower surface of each of the upper surfaces of the second coil pattern 312, and the auxiliary lead-out patterns 341 and 342 from the lower surface of the insulating substrate 200. In this case, since a recess may be formed in the lower surface of each of the upper surfaces of the second coil pattern 312, and the auxiliary lead-out patterns 341 and 342, the lower surface of each of the upper surfaces of the second coil pattern 312, and the auxiliary lead-out patterns 341 and 342, and the lower surface of the insulating substrate 200 may not be located on the same plane.

Each of the coil patterns 311 and 312, the lead-out patterns 331 and 332, the auxiliary lead-out patterns 341 and 342, and the vias 321, 322, and 323 may be formed of a conductive material such as copper (Cu), aluminum (Al), silver (Ag), tin (Sn), gold (Au), nickel (Ni), lead (Pb), titanium (Ti), or alloys thereof, but is not limited thereto.

Referring to FIG. 3, the first auxiliary lead-out pattern 341 may be independent of the electrical connection between the rest of the components of the coil portion 300, and thus may be omitted in the present disclosure. The first auxiliary lead-out pattern 341 may be formed to omit an operation of distinguishing the fifth surface 105 and the sixth surface 106 of the body 100 from each other.

The external electrodes 500 and 600 may be arranged to be spaced apart from each other on the sixth surface 106 of the body 100.

The external electrodes 500 and 600 may have a single-layer structure or a multilayer structure. For example, a first external electrode 500 may include a first layer comprising copper (Cu), a second layer disposed on the first layer and comprising nickel (Ni), and a third layer disposed on the second layer and comprising tin (Sn). As another example, the first external electrode 500 may include a resin electrode including a conductive powder particle and a resin, and a plating layer formed by a plating process on the resin electrode.

The external electrodes 500 and 600 may be formed of a conductive material such as copper (Cu), aluminum (Al), silver (Ag), tin (Sn), gold (Au), nickel (Ni), lead (Pb), titanium (Ti), or alloys thereof, but is not limited thereto.

FIG. 1 illustrates that a width of the body 100 may be the same as a distance of the external electrodes 500 and 600 in the width direction W of the body 100, but is merely illustrative. Sizes of the external electrodes 500 and 600 may be formed in a different manner to the size of FIG. 1.

The connection electrodes 410 and 420 may pass through the body 100 to connect the first and second external electrodes 500 and 600 to the first and second lead-out patterns 331 and 332. The first connection electrode 410 may connect the first external electrode 500 to the first lead-out pattern 331, and the second connection electrode 420 may connect the second external electrode 600 and the second lead-out pattern 332. The connection electrodes 410 and 420 may extend from the lead-out patterns as the first and second connection electrodes, respectively.

The connection electrodes 410 and 420 may be disposed on the lead-out patterns 331 and 332, before the operation of stacking a magnetic composite sheet, to form the body 100, or may be formed by stacking a magnetic composite sheet, forming a hole passing through at least a portion of the magnetic composite sheet, and filling the hole with a conductive material. In the former case, since a seed layer is not required in forming the connection electrodes 410 and 420 by an electrolytic plating process, the connection electrodes 410 and 420 may be formed with only the electrolytic plating layer. Since it is unnecessary to process the hole in the body 100 to expose the lead-out patterns 331 and 332 as compared with the latter case, it is possible to more precisely match the connection electrodes 410 and 420 and the lead-out patterns 331 and 332, and may be collectively formed in a plurality of unit coils at a strip level or a panel level. In the latter case, a seed layer such as an electroless plating layer may be interposed between the hole and the connection electrodes 410 and 420, and between the lead-out patterns 331 and 332 and the connection electrodes 410 and 420.

The connection electrodes 410 and 420 may be formed of a conductive material such as copper (Cu), aluminum (Al), silver (Ag), tin (Sn), gold (Au), nickel (Ni), lead (Pb), titanium (Ti), or alloys thereof, but is not limited thereto.

The support portions 710 and 720 may extend from the coil portion 300, may be exposed from one of the first to fourth surfaces 101, 102, 103, and 104 of the body 100, and may be arranged to be spaced apart from the lead-out patterns 331 and 332. The support portions 710 and 720 may be distinguished and physically separated from the lead-out patterns 331 and 332.

The support portions 710 and 720 may be exposed from the first and second surfaces 101 and 102 of the body 100, facing each other. Specifically, the first support portion 710 may extend from the outermost turn of the first coil pattern 311 to be exposed from the third surface 103 of the body 100, and the first support portion 720 may extend from the outermost turn of the second coil pattern 312 to be exposed from the fourth side 104 of the body 100.

The support portions 710 and 720 may electrically and physically connect neighboring unit coils to each other, and support the neighboring unit coils during the manufacturing process. This will be described later. When the plurality of unit coils are separated by an individualization process such as dicing, the support portions 710 and 720 may be cut and exposed from a side surface of each unit component.

Referring to FIGS. 2, and 6A to 6D, the support portions 710 and 720 may be formed symmetrically with respect to the coil portion 300. In this case, the expression of "being symmetrically formed" may be a concept including point symmetry and line symmetry.

Figure 6A:
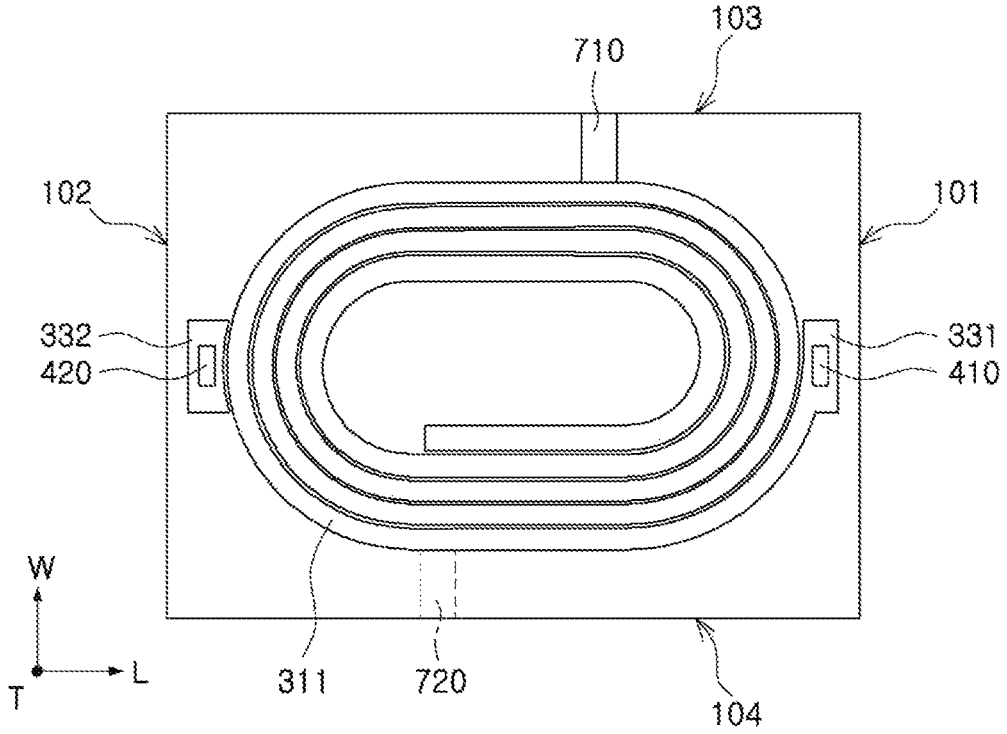
FIGS. 6A to 6D schematically illustrate a modified example of a support portion, respectively, corresponding to FIG. 2.

The support portions 710 and 720 may be formed symmetrically with each other in a central portion of the body 100 in the length direction, as illustrated in FIG. 2. The support portions 710 and 720 may be spaced apart from each other by substantially the same distance from a center line of the body 100 in the length direction, as illustrated in FIG. 6A.

Figure 6B:
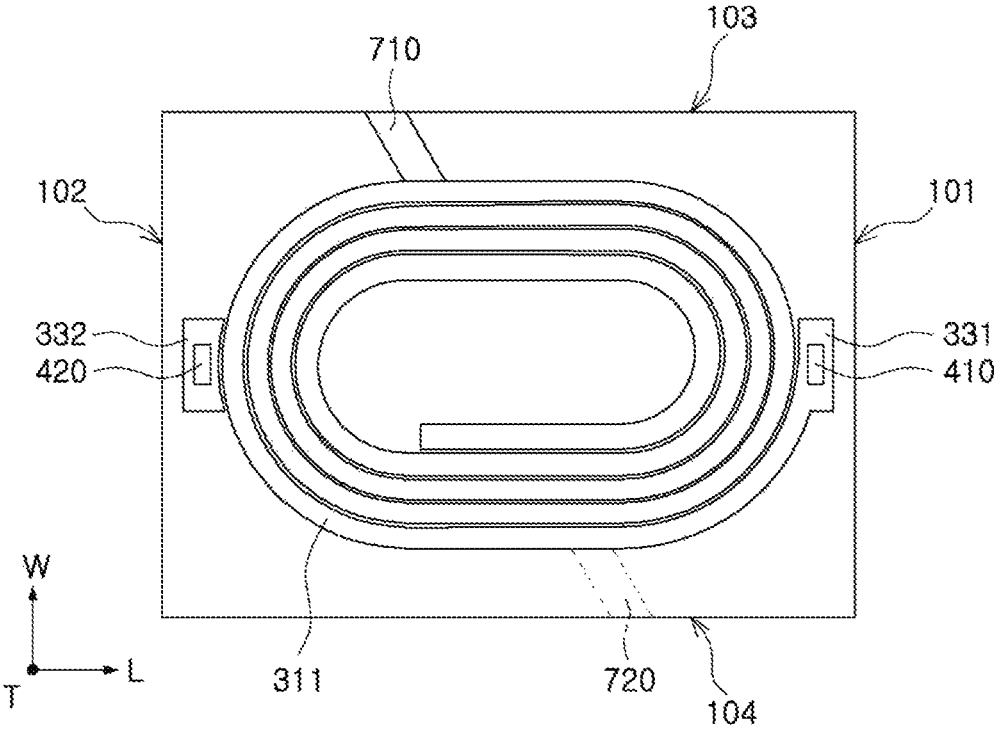

The support portions 710 and 720 may be arranged to have a certain angle with the width direction of the body 100, as illustrated in FIG. 6B. In this case, a linear width of each of the support portions 710 and 720 may be narrower than a length in an exposed surface of each of the support portions 710 and 720. For example, a cross-sectional area of each of the support portions 710 and 720 may be smaller than an area of an exposed surface of each of the support portions 710 and 720.

Figure 6C:
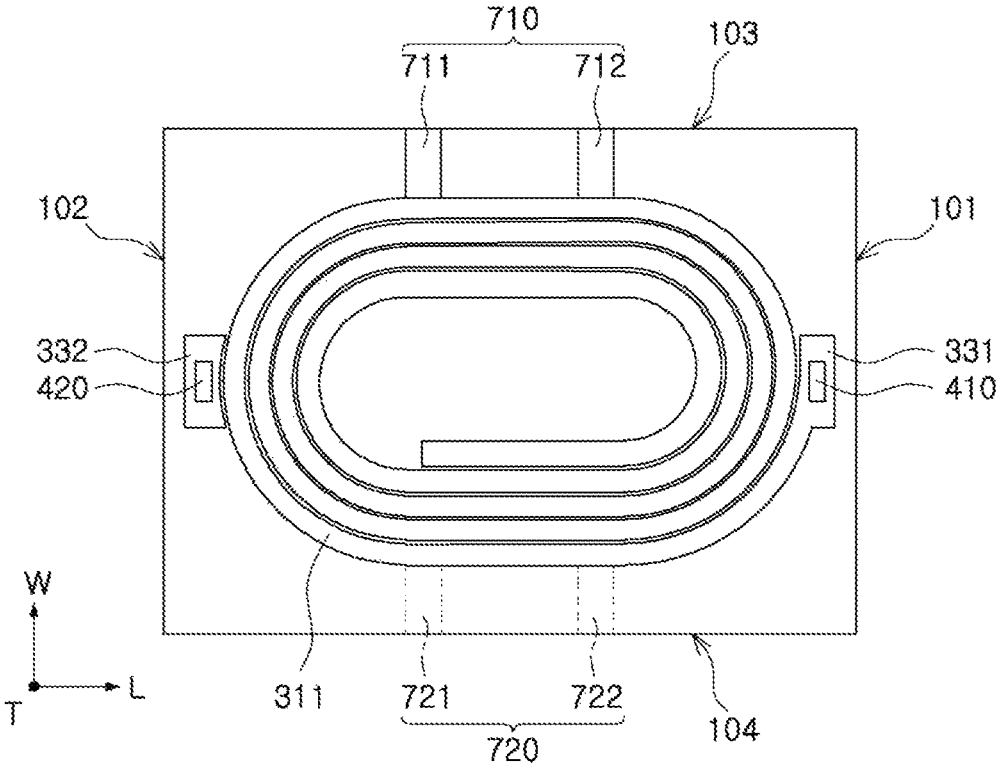
Figure 6D:
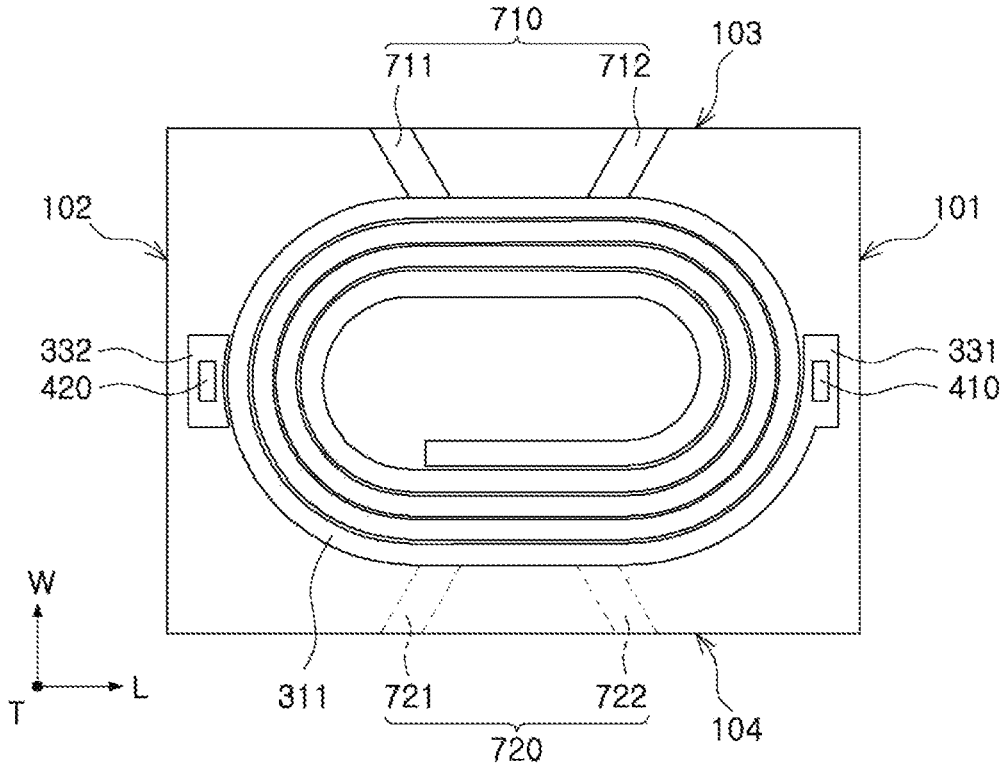

Referring to FIGS. 6C and 6D, a first support portion 710 (including 711 and 712) and a second support portion 720 (including 721 and 722) may be formed in plural, respectively. In this case, each of the first support portion 710 (including 711 and 712) and the second support portion 720 (including 721 and 722) may be formed as a pair, respectively, and a pair of first support portion 710 (including 711 and 712) and a pair of second support portion 720 (including 721 and 722) may be formed symmetrically with respect to each other.

The support portions 710 and 720 and the coil patterns 311 and 312 may be formed at the same time in the same electroplating process, and may be integrally formed without forming a boundary therebetween. Alternatively, the support portions 710 and 720 and the coil patterns 311 and 312 may be formed in different electroplating processes, and a boundary therebetween may be formed.

The support portions 710 and 720 may be formed of a conductive material such as copper (Cu), aluminum (Al), silver (Ag), tin (Sn), gold (Au), nickel (Ni), lead (Pb), titanium (Ti), or alloys thereof, but is not limited thereto.

Although not illustrated, according to an exemplary embodiment of the present disclosure, an insulating film may be formed along surfaces of the lead-out patterns 331 and 332, the coil patterns 311 and 312, the insulating substrate 200, the auxiliary lead-out patterns 341 and 342, and the support portions 710 and 720. The insulating film may be for insulating the lead-out patterns 331 and 332, the coil patterns 311 and 312, and the auxiliary lead-out patterns 341 and 342 from the body 100, and may include a known insulating material such as parylene, and the like. An insulating material included in the insulation film 600 may be any material, and is not particularly limited thereto. The insulation film 600 may be formed using a vapor deposition process or the like, but not limited thereto, and may be formed by stacking an insulation film on both surfaces of the insulating substrate 200.

Typically, a thin film type coil component may be manufactured at a strip level or a panel level, to produce a plurality of unit components in a batch, and the plurality of unit components may be separated through an individualization process such as dicing. Electrical and physical coupling between neighboring unit coils may be required to form a plurality of unit coils at a strip level or a panel level by a plating process in a batch, and to stack magnetic composite sheets to form a body. Specifically, regions of forming neighboring unit coils should be electrically connected to each other such that electrolytic plating process may be carried out in a batch, and neighboring unit coils may be physically connected and mutually supported, such that variation in position of the unit coils during stacking of the magnetic composite sheets may be minimized. The conventional lead-out portion simultaneously takes charge of the above-mentioned function of coupling neighboring unit components, and the function of electrically connecting the external electrodes to each other after the individualization the components.

It is obvious that a size of the lead-out portion should decrease as the coil component is thinned. There has been a limit in reducing a size of the lead-out pattern, in order to secure the coupling reliability between the lead-out portion and the external electrode and/or due to current concentration at the time of electroplating, and the like.

In the case of the present disclosure, the support portions 710 and 720 may be responsible for the electrical and physical connection between neighboring unit coils of the conventional lead-out portion. Therefore, the lead-out patterns 331 and 332 of the present disclosure may only be responsible for connecting the external electrodes 500 and 600. Therefore, the size of the lead-out patterns 331 and 332 may be reduced.

Further, according to an exemplary embodiment of the present disclosure, since connection electrodes 410 and 420 may be formed before the stacking of the magnetic composite sheet, the lead-out patterns 331 and 332 themselves may be deleted. For example, when the connection electrodes 410 and 420 may be formed after the formation of the body 100, the lead-out patterns 331 and 332 may be formed in a relatively large scale for matching between the connection electrodes 410 and 420. The connection electrodes 410 and 420 may be formed directly on the end portions of the outermost turn of the coil patterns 311 and 312, since the connection electrodes 410 and 420 may be formed before the stacking of the magnetic composite sheet.

As described above, the coil component 1000 according to an exemplary embodiment of the present disclosure may form the lead-out patterns 311 and 312 in a relatively small scale. Therefore, the total volume of the magnetic body within the same component volume may be improved. Further, while the lead-out patterns 311 and 312 may be formed to be relatively small, neighboring unit coils during the manufacturing process may be connected to each other to be mutually supported.

According to the present disclosure, the coil component may be made thin.

Further, according to exemplary embodiments of the present disclosure, it is possible to maintain the position of a coil portion within a body to be relatively constant while thinning the coil portion.

While exemplary embodiments have been illustrated and described above, it will be apparent to those skilled in the art that modifications and variations could be made without departing from the scope of the present disclosure as defined by the appended claims.

What is claimed is:

1. A coil component, comprising:

a body having a first surface and a second surface facing each other in one direction, and having a plurality of wall surfaces connecting the first surface and the second surface to each other;

an insulating substrate embedded in the body;

a coil portion comprising a first lead-out pattern and a second lead-out pattern each covered with the body and disposed on the insulating substrate;

a first external electrode and a second external electrode disposed on the first surface of the body and spaced apart from each other;

a first connection electrode and a second connection electrode respectively extending from the first and second lead-out patterns to the first and second external electrodes; and a first support portion and a second support portion each extending from the coil portion to one of the plurality of wall surfaces of the body, and being spaced apart from the first and second lead-out patterns, respectively, wherein the first and second support portions are exposed to two opposing surfaces among the plurality of wall surfaces of the body, without being connected to any external electrode.

2. The coil component according to claim 1, wherein an area of each of exposed surfaces of the first and second support portions is larger than a cross-sectional area of each of the first and second support portions, wherein the cross-sectional areas of the first and second support portions are in parallel with respective line widths of the first and second support portions.

3. The coil component according to claim 1, wherein the first and second support portions respectively include a pair of first support portions and a pair of second support portions, wherein the pair of first support portions and the pair of second support portions are symmetrically disposed on the coil portion.

4. The coil component according to claim 1, wherein the first and second support portions respectively include a plurality of first support portions and a plurality of second support portions.

5. The coil component according to claim 1, wherein the first and second lead-out patterns are arranged on a first surface of the insulating substrate facing the first surface of the body, and are spaced apart from each other.

6. The coil component according to claim 5, wherein the coil portion further comprises:

a first coil pattern disposed on the first surface of the insulating substrate, being in contact with the first lead-out pattern, and being spaced apart from the second lead-out pattern;

a second coil pattern disposed on a second surface of the insulating substrate opposing the first surface of the insulating substrate; and a via penetrating the insulating substrate and connecting the first coil pattern and the second coil pattern to each other, wherein the first and second support portions respectively extend from the first and second coil patterns, and are disposed on the first surface and the second surface of the insulating substrate, respectively.

7. The coil component according to claim 6, wherein the coil portion further comprises an auxiliary lead-out pattern disposed on the second surface of the insulating substrate and being in contact with the second coil pattern and connected to the second lead-out pattern, wherein the second support portion is disposed on the second surface of the insulating substrate and spaced apart from the auxiliary lead-out pattern.

8. The coil component according to claim 6, wherein the coil portion further comprises:

a first auxiliary lead-out pattern disposed on the second surface of the insulating substrate, being spaced apart from the second coil pattern, and being connected to the first lead-out pattern; and a second auxiliary lead-out pattern disposed on the second surface of the insulating substrate, being in contact with the second coil pattern, and being connected to the second lead-out pattern, wherein the second support portion is disposed on the second surface of the insulating substrate and spaced apart from the first and second auxiliary lead-out patterns.

9. The coil component according to claim 1, wherein the first and second lead-out patterns are spaced apart from each of the plurality of wall surfaces of the body.

10. The coil component according to claim 1, wherein the first and second support portions respectively extends from the coil portion to be exposed to two opposing surfaces of the plurality of wall surfaces of the body in a direction perpendicular to the two opposing surfaces.

11. The coil component according to claim 1, wherein the first and second support portions respectively extends from the coil portion to be exposed to two opposing surfaces of the plurality of wall surfaces of the body in a direction tilted to the two opposing surfaces.

12. The coil component according to claim 1, wherein each of the first and second support portions is exposed to a single surface among the plurality of wall surfaces of the body.

13. A coil component, comprising:

a body;

an insulating substrate embedded in the body;

a coil pattern, having a planar spiral shape, disposed on at least one surface of the insulating substrate and including at least one turn;

an external electrode disposed on one surface of the body;

a connection electrode embedded in the body, and being in contact with an end portion of an outermost turn of the coil pattern and the external electrode; and a pair of support portions respectively extending from the outermost turn of the coil pattern to two opposing surfaces among a plurality of side surfaces of the body, and being spaced apart from the end portion of the outermost turn, wherein the pair of support portions are exposed to the two opposing surfaces among the plurality of side surfaces of the body that are connected to the one surface of the body, without being connected to any external electrode.

14. The coil component according to claim 13, wherein each of the pair of support portions is exposed to a single surface among the plurality of side surfaces of the body.

15. A coil component, comprising:

a body having a first surface and a second surface facing each other in one direction, and having a plurality of wall surfaces connecting the first surface and the second surface to each other;

an insulating substrate embedded in the body;

a coil portion comprising a first lead-out pattern and a second lead-out pattern respectively disposed on the insulating substrate;

a first external electrode and a second external electrode disposed on the first surface of the body, being spaced apart from each other, and respectively connected to the first and second lead-out patterns; and at least one support portion extending from the coil portion to one of the plurality of wall surfaces of the body, and being spaced apart from the first and second lead-out patterns, wherein the at least one support portion includes first and second support portions that are exposed to two opposing surfaces among the plurality of wall surfaces of the body, without being connected to any external electrode.

16. The coil component according to claim 15, further comprising a first connection electrode and a second connection electrode respectively extending from the first and second lead-out patterns to the first and second external electrodes.

17. The coil component according to claim 15, wherein each of the first and second support portions is exposed to a single surface among the plurality of wall surfaces of the body.

* * * * *